US011457513B2

(12) United States Patent
Lutz, II et al.

(10) Patent No.: US 11,457,513 B2
(45) Date of Patent: Sep. 27, 2022

(54) CERAMIC HEATING ELEMENT

(71) Applicant: Bradley Fixtures Corporation, Menomonee Falls, WI (US)

(72) Inventors: Kenneth E. Lutz, II, Delton, MI (US); Mark A. Figurski, Harland, WI (US); Daniel James Thomas, Middleville, MI (US); Benjamin James Hull, Hastings, MI (US)

(73) Assignee: Bradford White Corporation, Ambler, PA (US)

( * ) Notice: Subject to any disclaimer, the term of this patent is extended or adjusted under 35 U.S.C. 154(b) by 313 days.

(21) Appl. No.: 15/486,816

(22) Filed: Apr. 13, 2017

(65) Prior Publication Data

US 2018/0302954 A1 Oct. 18, 2018

(51) Int. Cl.

| | |
|---|---|
| ***H05B 3/78*** | (2006.01) |
| ***H05B 3/82*** | (2006.01) |
| ***H05B 3/48*** | (2006.01) |
| ***H05B 3/46*** | (2006.01) |

(52) U.S. Cl.

CPC ..... *H05B 3/78* (2013.01); *H05B 3/46* (2013.01); *H05B 3/48* (2013.01); *H05B 3/82* (2013.01); *H05B 2203/017* (2013.01); *H05B 2203/021* (2013.01)

(58) Field of Classification Search

CPC ... H05B 3/14; H05B 3/16; H05B 3/18; H05B 3/40; H05B 3/42; H05B 3/44; H05B 3/48; H05B 3/78; H05B 2203/021

USPC ..... 219/544

See application file for complete search history.

(56) References Cited

U.S. PATENT DOCUMENTS

| | | | | |
|---|---|---|---|---|
| 3,982,099 A * | 9/1976 | Churchill | ..... | H05B 3/06 219/544 |
| 4,160,897 A | 6/1979 | Makino | | |
| 4,449,039 A | 5/1984 | Fukazawa et al. | | |
| 4,786,781 A | 11/1988 | Nozaki et al. | | |

(Continued)

FOREIGN PATENT DOCUMENTS

| | | |
|---|---|---|
| EP | 0771773 A2 | 5/1997 |
| GB | 1518833 A | 7/1978 |

(Continued)

OTHER PUBLICATIONS

International Search Report for PCT/US2018/027477, dated Jul. 10, 2018; 103 pages (Continued)

*Primary Examiner* — Erin E McGrath

(74) *Attorney, Agent, or Firm* — RatnerPrestia

(57) ABSTRACT

A heating element including a preformed ceramic tubular body having a hollow cavity centrally located within, a heat-generating component disposed within the hollow cavity, and an air-displacement material disposed within the hollow cavity. The preformed ceramic tubular body is one of aluminum oxide, aluminum nitride, and silicon nitride ceramic. The heat-generating component may be in electrical contact with the ceramic tubular body. The air-displacement material is magnesium oxide. Further, the heat-generating component and the air-displacement material are disposed within the hollow cavity of the preformed ceramic tubular body by way of at least one of a vibrating fill and a centrifuge for compaction.

12 Claims, 7 Drawing Sheets

(56) References Cited

U.S. PATENT DOCUMENTS

| | | | | |
|---|---|---|---|---|
| 5,073,689 | A | 12/1991 | Tabata et al. | |
| 5,084,606 | A * | 1/1992 | Bailey | F23Q 7/001 219/270 |
| 5,233,166 | A | 8/1993 | Maeda et al. | |
| 6,075,230 | A | 6/2000 | Wilson | |
| 6,124,579 | A | 9/2000 | Steinhauser | |
| 6,188,051 | B1 | 2/2001 | Kusek | |
| 6,218,648 | B1 | 4/2001 | Miyata et al. | |
| 6,265,700 | B1 | 7/2001 | Miyata et al. | |
| 6,539,171 | B2 | 3/2003 | VonArx et al. | |
| 6,744,016 | B2 | 6/2004 | Watanabe et al. | |
| 6,744,978 | B2 | 6/2004 | Tweedy et al. | |
| 7,282,669 | B2 | 10/2007 | Tatematsu et al. | |
| 7,947,933 | B2 | 5/2011 | Nagasako et al. | |
| 8,952,302 | B2 | 2/2015 | Park | |
| 9,113,501 | B2 | 8/2015 | Long et al. | |
| 9,224,626 | B2 | 12/2015 | Lindley et al. | |
| 9,245,775 | B2 | 1/2016 | Kondo et al. | |
| 9,249,292 | B2 | 2/2016 | Hamakura et al. | |
| 9,260,320 | B2 | 2/2016 | Kanamura et al. | |
| 9,265,093 | B2 | 2/2016 | Waechter et al. | |
| 9,269,644 | B2 | 2/2016 | Nishimura et al. | |
| 2002/0027130 | A1 * | 3/2002 | Miyata | H05B 3/143 219/444.1 |
| 2003/0187118 | A1 | 10/2003 | Aronica | |
| 2004/0146289 | A1 | 7/2004 | Sakamoto et al. | |
| 2004/0234255 | A1 | 11/2004 | Yui | |
| 2008/0185375 | A1 * | 8/2008 | Cho | H05B 3/009 219/553 |
| 2009/0020518 | A1 * | 1/2009 | Ikeda | A47K 13/302 219/217 |
| 2011/0008030 | A1 | 1/2011 | Luo | |
| 2011/0253704 | A1 | 10/2011 | Yamamoto | |
| 2016/0033169 | A1 | 2/2016 | Hantschel | |
| 2016/0061147 | A1 | 3/2016 | Aten et al. | |

FOREIGN PATENT DOCUMENTS

| | | | |
|---|---|---|---|
| JP | H07208740 | A | 8/1995 |
| JP | H07208741 | A | 8/1995 |
| JP | H08250262 | A | 9/1996 |
| JP | 2001267045 | A | 9/2001 |
| KR | 200200328 | Y1 | 10/2000 |

OTHER PUBLICATIONS

Pelonis Technologies Inc., Ultra-High Temperature Ceramic Immersion Heaters, http://catalog.pelonistechnologies.com/category/ultra-high-temperature-ceramic-immersion-heaters? hssc=86600839.5.1464879880300&_hstc=86600839.8332f4c3734416879c8298ebb66fe688.1464879880299.1464879880299.1464879880299.1&_hsfp=1527483646&hsCtaTracking=6c6bb018-c39d-46d4-9667-8ceef981b250%7C8367a144-56ce-4b4e-8667-e8d1750925da.

Chromolax, Ceramic Sheathed Immersion Heater, http://www.chromalox.com/catalog/resources/MOD-CS.pdf.

EP 18784108.5, Extended European Search Report, dated Nov. 24, 2020.

* cited by examiner

CERAMIC HEATING ELEMENT

BACKGROUND OF THE INVENTION

1. Field of the Invention

The present invention relates to a heating element and method of manufacturing the heating element. The heating element comprises materials which increase the efficiency and durability of the immersion heater.

2. Discussion of the Related Art

Heating elements such as immersion heaters are routinely used in water heaters and, more specifically, tankless water heaters. In one instance, it is known in the art to use an exposed electrode heating element as the immersion heater. However, in this instance, the electrode resistive wire is left exposed to the corrosive environment of the water, and the life and reliability is dramatically shortened. In addition, the electrode resistive wire is highly susceptible to failure due to localized boiling at the wire or air bubbles passing through the heat exchanger, which can cause high surface temperatures and oxidation. It is not uncommon for heaters using this style to fail after 9 to 18 months of use.

In another instance, it is known in the art to use a metal sheathed tubular heating element as the immersion heater. The resistance wire is centered in the sheath and electrically insulated with compacted, high-grade magnesium oxide (MgO). The heating element distributes heat to the sheath. In these known applications, the sheath material is typically copper, steel, 304 stainless steel, 316 stainless steel, and Incoloy® 800. The most durable of the above-mentioned sheath alloys is the Incoloy® 800, which is more tolerant of elevated temperatures and provides better corrosion protection than the other alloys discussed above. For example, while copper has the best thermal transfer rate of the alloys discussed above, it lacks the ability to resist the effects of elevated temperatures (heat-related stress) and is susceptible to corrosion.

A practical limit of watt density for a metal-sheathed tubular heating element before experiencing heat-related failures is 120 watts per square inch. In turn, the limit on watt density also limits how small one can create the metal-sheathed tubular heating element. If one skilled in the art was able to create a sheath that could withstand watt densities higher than 120 watts per square inch, then a smaller immersion heater could be used, which could result in a smaller water heater package. Further, the need to insulate the resistive wire from the metal sheath also limits the size of the metal-sheathed tubular heating element. A smaller immersion heater and smaller water heater package results in savings in both cost and space. It is also important to maintain or improve on the expected life of a metal sheath heating element constructed of Incoloy 800 and designed at the 120 watts per square inch. Life expectancy is measured in years rather than months.

As such, there is a need in the art for a sheathed heating element comprising a material that allows a watt density higher than that of standard alloy sheaths, which in turn allows for a smaller sheathed tubular heating element to be used. In addition, there is a need in the art for a sheathed tubular heating element that requires minimal to no separation between the interior resistive element and the sheath, which, in turn, allows for a smaller sheathed tubular heating element and can provide improved heat transfer to the heated fluid, gas, or other solid material in contact with the body.

SUMMARY OF THE INVENTION

The present invention is a heating element such as, but not limited to, an immersion heater, for use in an apparatus for heating a liquid, gas, or solid material such as, but not limited to, a water heater. The inventive heating element described in this application provides increased efficiency and increased durability compared to heating elements known in the prior art.

In accordance with an embodiment of the invention, a heating element includes a preformed ceramic tubular body having a hollow cavity centrally located within, a heat-generating component disposed within the hollow cavity, and an air-displacement material disposed within the hollow cavity. The preformed ceramic tubular body is one of aluminum oxide, aluminum nitride, and silicon nitride ceramic. The heat-generating component may be in direct contact with the ceramic tubular body. The air-displacement material is magnesium oxide. Further, the heat-generating component and the air-displacement material are disposed within the hollow cavity of the preformed ceramic tubular body by way of at least one of a vibrating fill and a centrifuge compaction.

According to another embodiment of the invention, a heating element includes a preformed tubular body having a hollow cavity centrally located within, a heat-generating component disposed within the hollow cavity, and an air-displacement material disposed within the hollow cavity. The tubular body is an electrically non-conductive material. The heat-generating component may be in direct contact with the preformed tubular body.

In accordance with yet another embodiment of the invention, one method of manufacturing a heating element includes preforming a ceramic tubular body having a hollow cavity centrally located within, disposing a heat-generating component within the hollow cavity, the heat-generating component being in direct contact with the tubular body and filling the hollow cavity with an air-displacement material.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
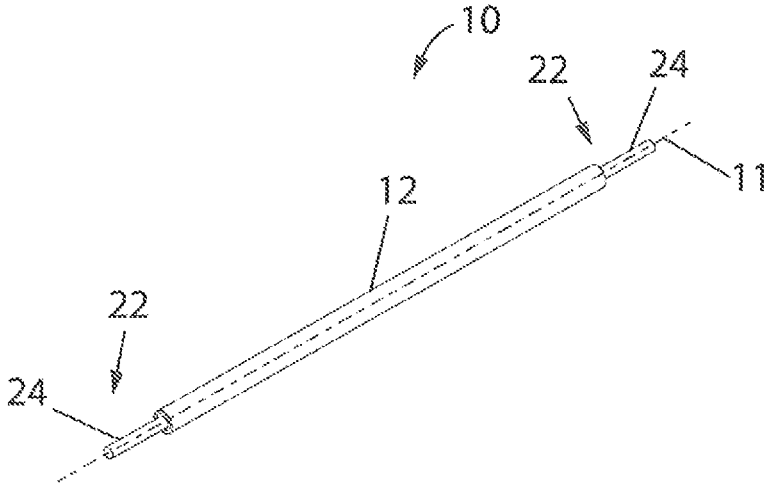
FIG. 1 is a perspective view of a double-ended heating element, according to an embodiment of the invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DESCRIPTION OF PREFERRED EMBODIMENTS

The present invention and the various features and advantageous details thereof are explained more fully with reference to the non-limiting embodiments described in detail in the following description.

First referring to FIG. 1, a perspective view of a double-ended heating element 10 is shown. Heating element 10 is able to be inserted into an apparatus, such as, but not limited to, a liquid heater, in order to heat a gas, solid material, or liquid, such as, but not limited to, water, within the apparatus. The heating element 10 includes a tubular body 12. In this embodiment, tubular refers to a variety of hollow bodies which may be cylindrical, ovular, or any other custom geometry. The heating element 10 includes electrodes 24 that extend beyond the ends 22 of the tubular body 12. The configuration of the electrodes 24 will be described in further detail with regard to FIGS. 3-5. While FIG. 1 illustrates only one tubular body 12 in a specific configuration, it is also contemplated that the heating element 10 may include a plurality of tubular bodies 12 in any number of configurations. In this representative embodiment of the invention, the heating element 10 is oriented in a linear configuration, resulting in the electrodes 24 being disposed in opposite directions along a plane 11.

Figure 2:
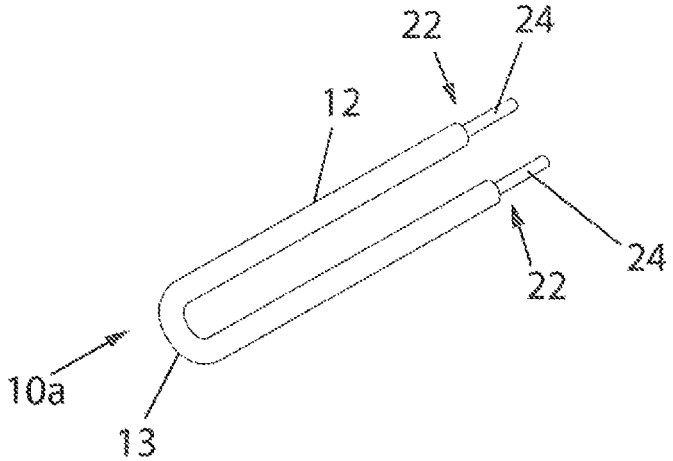
FIG. 2 is a perspective view of a double-ended heating element, according to another embodiment of the invention.

FIG. 2 illustrates an alternative embodiment of the invention, wherein the double-ended heating element 10*a* is configured to include a bend 13. As a result of the bend 13, the electrodes 24 of the heating element 10*a* are oriented parallel to each other and in the same direction.

While the representative embodiment of FIG. 2 illustrates a bend 13 resulting in opposing ends 22 of the heating element 10*a* being oriented parallel to each other and in the same direction, alternative embodiments of the invention may include other configurations. For example, the bend 13 may be in the form of an S-bend resulting in the opposing ends 22 of the heating element 10*a* being oriented parallel to each other in opposite directions, but not along the same plane 11. Further the bend 13 may be in the form of a partial S-bend or U-bend resulting in the opposing ends 22 of the heating element 10*a* being oriented in different directions at any angle. All nonlinear features discussed above, such as the bend 13 in the tubular body 12 would be formed in the tubular body 12 by an appropriate manufacturing method such as but not limited to casting, investment casting, molding, and the like.

Figure 3A:
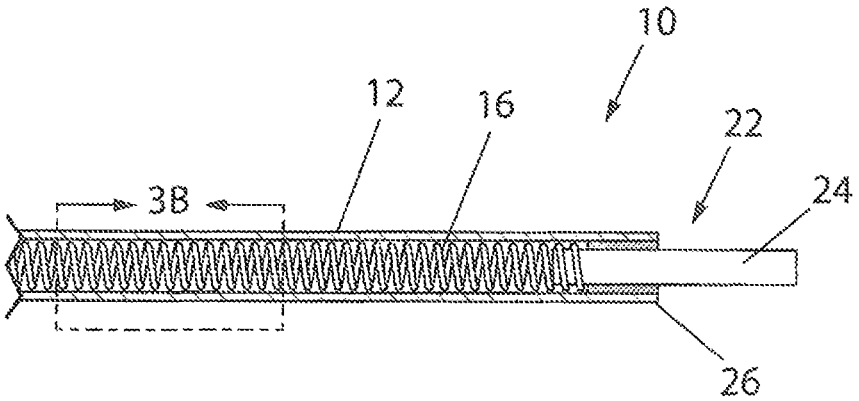
FIG. 3A is a cross-sectional view of a section of a double-ended heating element, according to an embodiment of the invention.
Figure 3B:
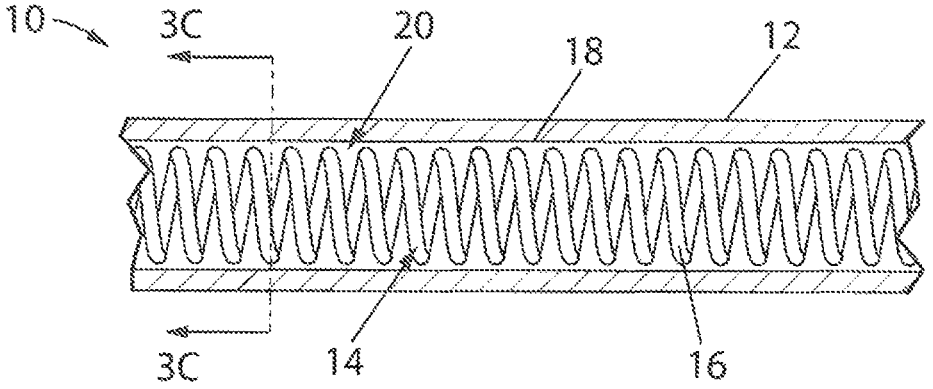
FIG. 3B is an enlarged cross-sectional view of section 3B of the heating element of FIG. 3A.
Figure 3C:
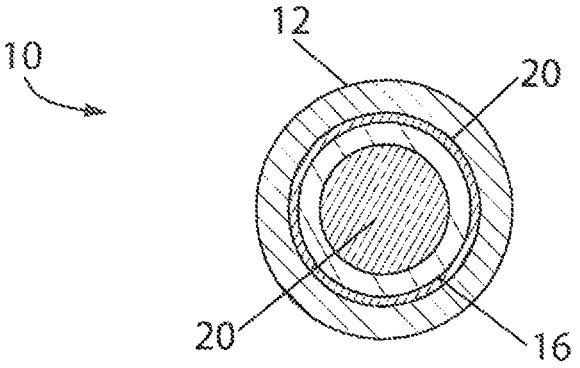
FIG. 3C is a cross-sectional view of a section of the heating element of FIG. 3B taken along line 3C.

Next, FIGS. 3A, 3B, and 3C depict a cross-sectional view of a section of a heating element, such as heating element 10. The heating element 10 includes a tubular body 12 having a hollow inner cavity 14 centrally located within the tubular body 12. In the representative embodiment of the invention, the tubular body 12 comprises an electrically insulative and thermally conductive material. For instance, the tubular body 12 may be a ceramic such as, but not limited to, aluminum oxide, aluminum nitride, and silicon nitride ceramic. One skilled in the art would understand that electrically insulative refers to the material of the tubular body 12 having a high electrical resistance.

According to the representative embodiment of the invention, the tubular body 12 is preformed into a thin-walled ceramic tube with the hollow cavity 14 therein. The tubular body 12 may be formed by way of extrusions and firing, pressing and sintering, or any other process known in the art.

A heat-generating component 16 is disposed within the cavity 14. While FIGS. 3A, 3B, and 3C illustrate the heat-generating component 16 in the form of a resistive wire, alternative embodiments of the invention (some of which will be described in later embodiments of the invention) may include other heat-generating components 16. In the representative embodiment of the invention, the resistive wire 16 is at least one of NiChrome 80 wire or Kanthal® A1 wire. However, it is also contemplated that the resistive wire 16 may comprise other materials. Further, the resistive wire 16 is wound in a continuous coil of sufficient total resistance to generate the desired wattage to heat the intended aforementioned liquid, solid, or gas. Afterward, the resistive wire 16 is placed within the cavity 14 of the tubular body 12 so as to be directly adjacent an inner surface 18 of the tubular body 12. It is also contemplated that the resistive wire 16 may be in direct contact with the inner surface 18 of the tubular body 12.

Next, a displacement material 20 such as, but not limited to, magnesium oxide (MgO) is used to fill the remaining space of the cavity 14. That is, any oxygen within the cavity is displaced by the magnesium oxide. By displacing the oxygen within the cavity with the displacement material 20, the life of the resistive wire 16 is extended. In addition, the displacement material 20 assists in conducting heat away from the resistive wire 16 and preventing any threat of a short circuit, either of which could reduce the life of the resistive wire 16.

At each end 22 of the tubular body 12, an electrode 24 is disposed within the cavity 14 so as to be in electrical contact with the resistive wire 16. Additionally, the electrode 24 extends beyond the end 22 of the tubular body 12, the end being sealed with an epoxy 26. By extending beyond the end 22 of the tubular body 12, the electrode 24 is configured to extend into the housing (not shown) so as to contact an electrical circuit (not shown) within the housing. As such, the electrode electrically connects the resistive wire 16 to the electrical circuit within the housing.

Figure 4A:
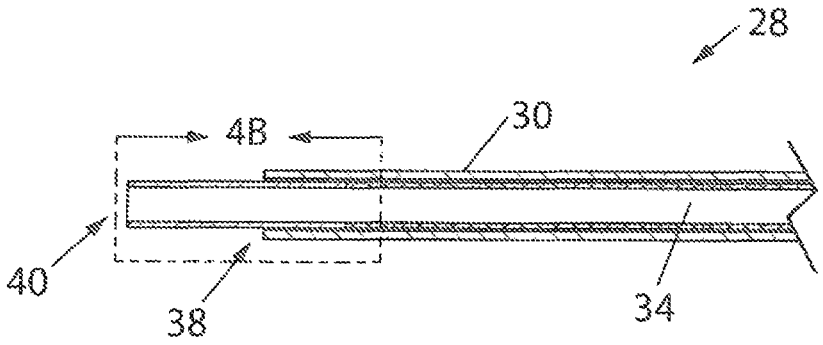
FIG. 4A is a cross-sectional view of a section of a double-ended heating element, according to another embodiment of the invention.
Figure 4B:
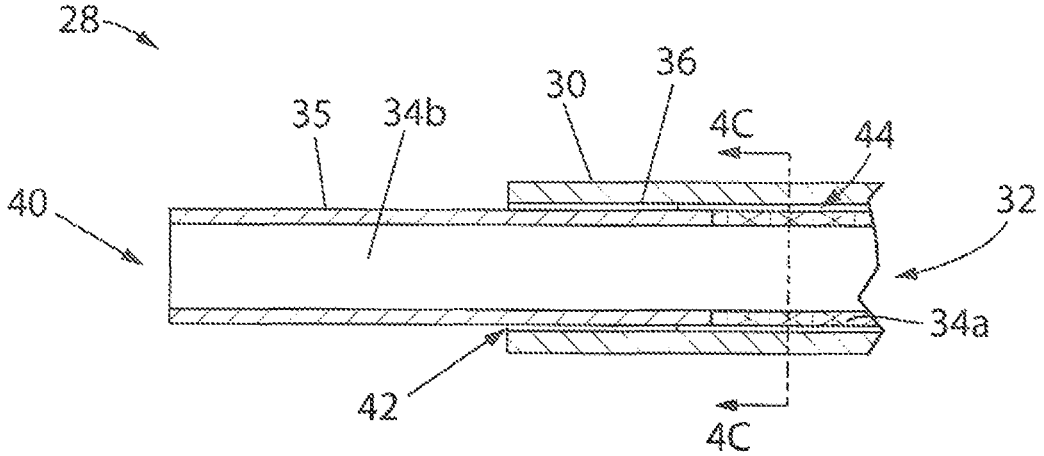
FIG. 4B is an enlarged cross-sectional view of section 4B of the heating element of FIG. 4A.
Figure 4C:
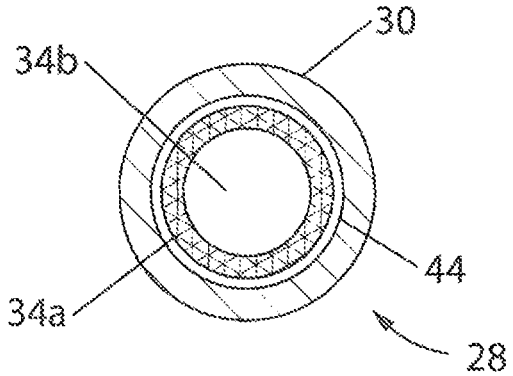
FIG. 4C is a cross-sectional view of a section of the heating element of FIG. 4B taken along line 4C.

Now referring to FIGS. 4A, 4B, and 4C, cross-sectional views of a heating element 28 are shown, according to an alternative embodiment of the invention. Similar to the heating element 10 seen in FIGS. 3A, 3B, and 3C, the heating element 28 of this representative embodiment includes a tubular body 30 comprising an electrically-insulative and thermally-conductive material. For example, the tubular body 30 may be a ceramic such as, but not limited to, aluminum oxide, aluminum nitride, and silicon nitride ceramic.

As discussed above with respect to the tubular body 12, the tubular body 30 is preformed into a thin-walled ceramic tube with the hollow cavity 32 therein. The tubular body 30 may be formed by way of extrusions and firing, pressing and sintering, or any other process known in the art.

In this representative embodiment of the invention, a heat-generating component 34 in the form of a resistive film 34*a* coated to a rod 34*b* is disposed within the cavity 32. The rod 34*b* comprises an electrically-resistive and thermally-conductive material, such as, but not limited to, a ceramic including aluminum oxide, aluminum nitride, silicon nitride, and/or the like. The heat-generating component 34 is placed within the cavity 32 of the tubular body 30 so that the resistive film 34*a* is directly adjacent to an inner surface 36 of the tubular body 30.

Additionally, the ceramic rod 34*b* extends beyond the ends 38 of the tubular body 30, where the rod 34*b* is over coated with a non-resistive film 35. As a result, electrodes 40 are formed by rod 34*b* and non-resistive film 35 extending beyond the ends 38 of the tubular body 30. An epoxy 42 may be disposed between the heating-generating component 34 and the tubular body 30 at the ends of the tubular body 30 in order to seal the heating element 28.

A displacement material 44 such as, but not limited to, magnesium oxide (MgO), is used to fill the remaining space of the cavity 32 in order to displace any oxygen within the cavity 32. Displacing the oxygen within the cavity with the displacement material 44 increases the life of the heat-generating component 34. For example, the displacement material 44 assists in conducting heat away from the heat-generating component 34 and preventing any threat of a short circuit, either of which could reduce the life of the heat-generating component 34.

Figure 5A:
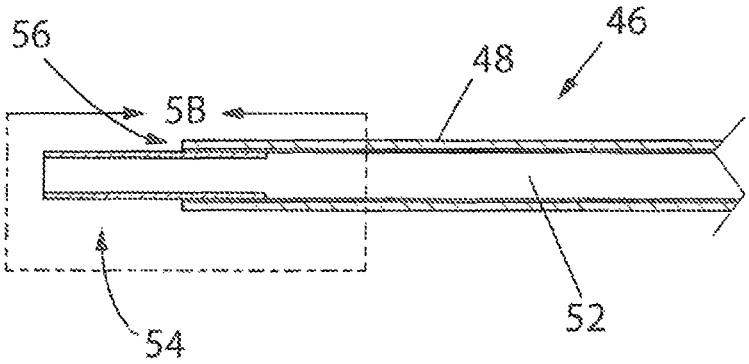
FIG. 5A is a cross-sectional view of a section of a double-ended heating element, according to another embodiment of the invention.
Figure 5B:
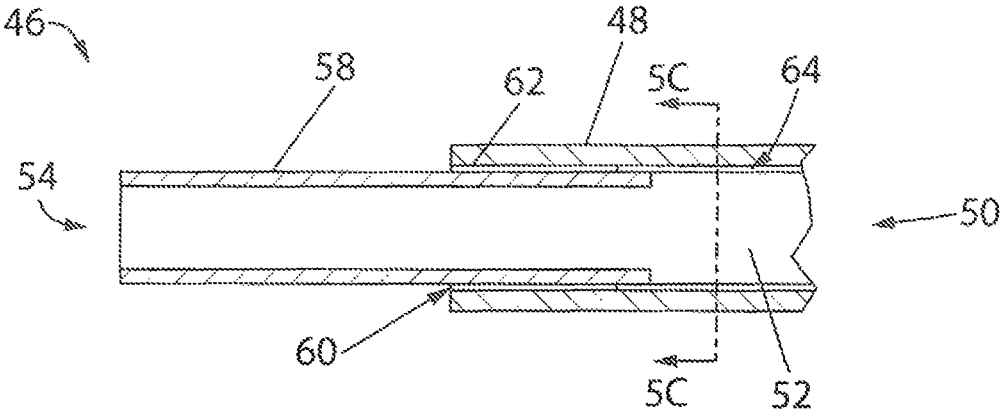
FIG. 5B is an enlarged cross-sectional view of section 5B of the heating element of FIG. 5A.
Figure 5C:
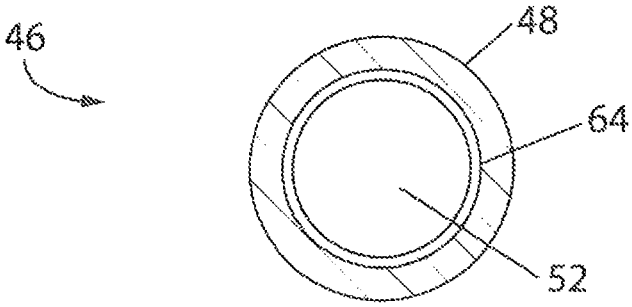
FIG. 5C is a cross-sectional view of the heating element of FIG. 5B taken along line 5C.

Next, FIGS. 5A, 5B, and 5C illustrate a cross-sectional view of a heating element 46 is shown, according to yet another alternative embodiment of the invention. Similar to the previously-described immersion heaters, the heating element 46 of this representative embodiment includes a tubular body 48 comprising an electrically-insulative and thermally-conductive material. For example, the tubular body 48 may be a ceramic such as, but not limited to, aluminum oxide, aluminum nitride, and silicon nitride. Further, the tubular body 48 is preformed into a thin-walled ceramic tube with the hollow cavity 50 therein by way of extrusions and firing, pressing and sintering, or any other process known in the art.

In this representative embodiment of the invention, a heat-generating component 52 in the form of a composite resistive core 52 is disposed within the cavity 50. In particular, the composite resistive core 52 is placed within the cavity 50 of the tubular body 48 so that the composite resistive core 52 is directly adjacent an inner surface 62 of the tubular body 48.

It is contemplated that the composite resistive core 52 may be formulated to proportion the resistive compound so as to provide the required resistance. The composite resistive core 52 may be formed by sintering in order to be molded into a shape that fits within the cavity 50 of the tubular body 48. For the purpose of this application, the term sintering may include the use of pressure and heat either alone or in combination. In the representative embodiment of the invention, the composite resistive core 52 may be in the form of a carbon-compound resistor or other resistive core. In alternative embodiments of the invention, the composite resistive core 52 may be disposed within the cavity 50 and the sintered, as defined above, in order to fit within and fill the cavity 50.

The heating element 46 may also include electrodes 54 disposed at the ends 56 of the tubular body 48. The electrodes 54 may be formed by the composite resistive core 52 extending beyond the ends 56 of the tubular body 48 and a non-resistive coating 58 applied to at least the portion of the composite resistive core 52 extending beyond the ends 56 of the tubular body 48. Further, an epoxy 60 may be disposed between the composite resistive core 52 and the tubular body 48 at the ends of the tubular body 56 in order to seal the heating element 46.

A displacement material 64 such as, but not limited to, magnesium oxide (MgO) may be used to fill the remaining space of the cavity 50 in order to displace any oxygen within the cavity 50, which results in increased the life of the composite resistive core 52. For example, the displacement material 64 assists in conducting heat away from the composite resistive core 52 and preventing any threat of a short circuit, either of which could reduce the life of the composite resistive core 52.

However, it is also contemplated that the embodiment of the invention using the composite resistive core 52 may not include the displacement material 64. That is, the composite resistive core 52 may be formed by pressing and sintering to be compacted within the tubular body 48.

Figure 6:
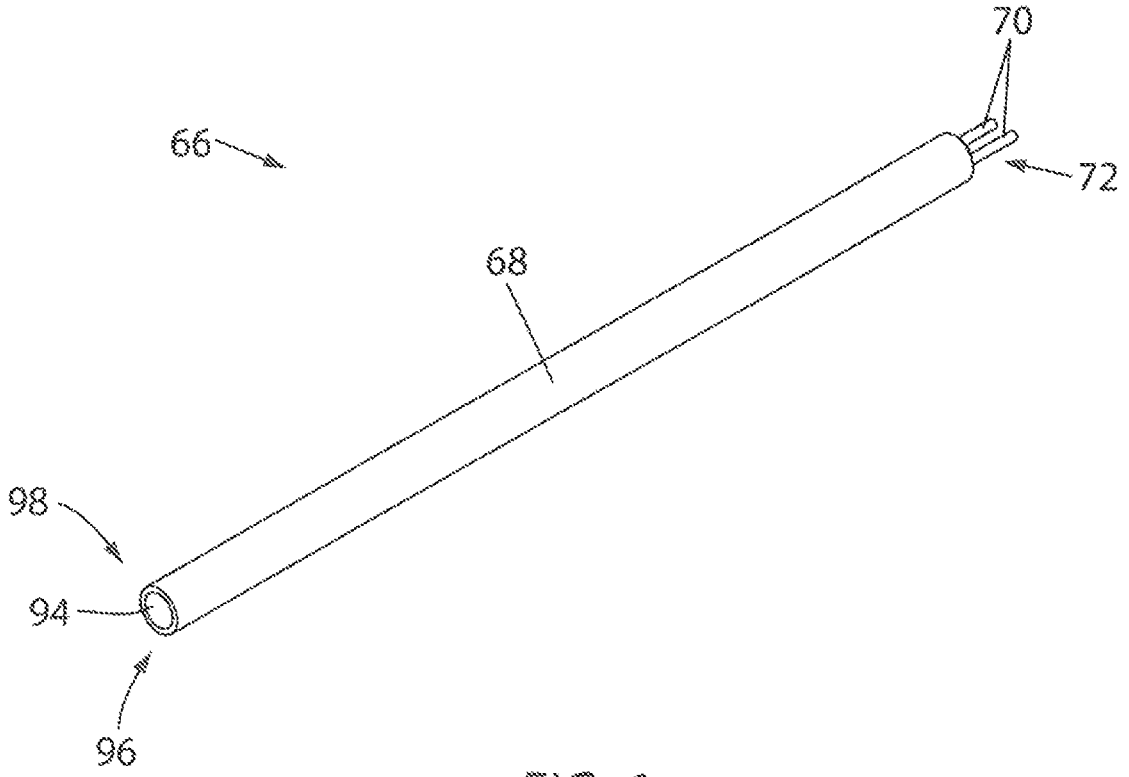
FIG. 6 is a perspective view of a single-ended heating element, according to an embodiment of the invention.

Now referring to FIG. 6, a perspective view of a single-ended heating element 66 is shown. Similar to the previously described heating elements, heating element 66 is able to be inserted into an apparatus, such as, but not limited to, a liquid heater, in order to heat the solid, gas, or liquid, such as, but not limited to, water, within the apparatus. The heating element 66 includes a tubular body 68. The heating element 66 includes electrodes 70 that extend beyond a first end 72 of the tubular body 68. As shown in FIG. 6, both electrodes extend beyond the same end 72 of the tubular body 68. An end plug 94 is located at a second end 98 of the tubular body 68. In the representative embodiment of the invention, the end plug 94 comprises a non-resistive material. For instance, the end plug 94 may be a ceramic such as, but not limited to, aluminum oxide, aluminum nitride, and silicon nitride ceramic. Alternative embodiments of the heating element 66 may include a plurality of tubular bodies 12 in any number of configurations.

Figure 7A:
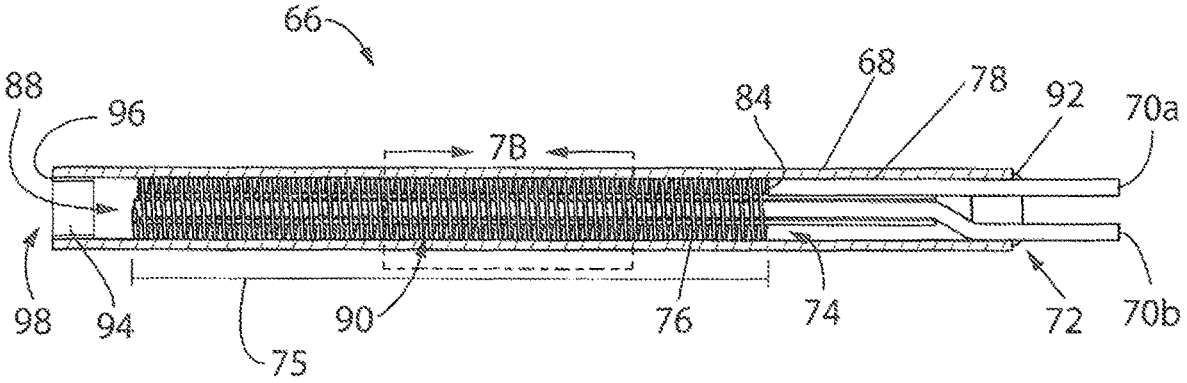
FIG. 7A is a cross-sectional view of a section of the heating element of FIG. 6.
Figure 7B:
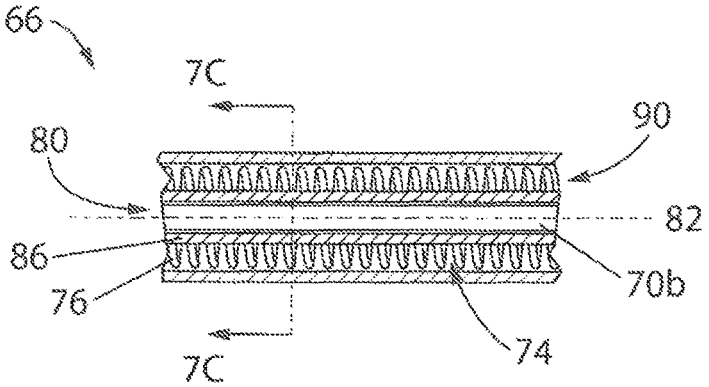
FIG. 7B is an enlarged cross-section view of section 7B of the heating element of FIG. 7A.
Figure 7C:
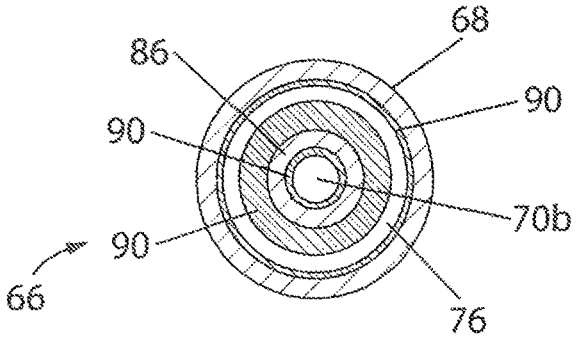
FIG. 7C is a cross-sectional view of the heating element of FIG. 7B taken along line 7C.

Next, FIGS. 7A, 7B, and 7C depict cross-sectional views of the heating element 66 to further illustrate the elements within a tubular body 68. The tubular body 68 of the heating element 66 includes a hollow inner cavity 74 centrally located within the tubular body 68. The tubular body 68 comprises an electrically insulative and thermally conductive material. For instance, the tubular body 68 may be a ceramic such as, but not limited to, aluminum oxide, aluminum nitride, and silicon nitride ceramic. The tubular body 68 may be preformed by way of extrusion and firing, pressing and sintering, or any other process known in the art.

Similar to the heating elements previously described above, a heat-generating component 76 is disposed within the cavity 74. In the representative embodiment of the invention, the heat-generating component 76 is in the form of a resistive wire. However, alternative embodiments of the invention may include other heat-generating components such as, but not limited to, those described above. The resistive wire 76 may be at least one of NiChrome 80 wire, Kanthal® A1 wire, or other similar materials. The resistive wire 76 is wound in a continuous coil of sufficient total resistance to generate the desired wattage to heat the intended aforementioned liquid, solid, or gas. Further, the resistive wire 76 is placed within the cavity 74 of the tubular body 68 so as to be directly adjacent an inner surface 78 of the hollow cavity 74.

FIGS. 7A, 7B, and 7C, depict the resistive wire 76 coiled within the hollow cavity 74 along a length 75 of the hollow cavity 74. In the representative embodiment of the invention, the length 75 is less than the entire length of the hollow cavity 74.

As shown in FIG. 7B, the coiled resistive wire 76 forms a second hollow cavity 80 centrally located within the coiled resistive wire 76. In the representative embodiment of the invention, the hollow cavity 74 of the tubular body 68 and the second hollow cavity 80 of the resistive wire 76 are both centered along a plane 82. However, in alternative embodiments of the invention the hollow cavity 74 of the tubular body 68 and the second hollow cavity 80 of the resistive wire 76 need not both be centered along the plane 82.

FIG. 7A further shows that electrodes 70 include a resistive wire electrode 70*a* and a returning electrode 70*b*. The resistive wire electrode 70*a* is disposed within the hollow cavity 74 of the tubular body 68 so as to be in contact with the resistive wire 76 and extend beyond the end 72 of the tubular body 68. As shown in FIG. 7A, the resistive wire electrode 70*a* is in contact with an end 84 of the resistive wire 76. In the representative embodiment of the invention, the resistive wire electrode 70*a* is in contact with end 84 of the resistive wire 76 and does not extend beyond the first end 84 of the resistive wire 76. However, in alternative embodiments of the invention, the resistive wire electrode 70*a* may extend into the cavity 80 of the resistive wire 76.

As shown in FIG. 7B, the returning electrode 70*b* is surrounded by a ceramic sleeve 86 in order to electrically isolate the returning electrode 70*b* from the resistive wire electrode 70*a*. The returning electrode 70*b* and ceramic sleeve 86 are disposed within the cavity 80 of the resistive wire 76. Prior to reaching the first end 72 of the tubular body 68, the returning electrode 70*b* exits the ceramic sleeve 86 and is displaced from the resistive wire electrode 70*a*. The returning electrode 70*b* then extends beyond the first end 72 of the tubular body 68. FIG. 7B further illustrates that the ceramic sleeve 86 and the returning electrode 70*b* extend from second end 88 of the resistive wire 76 beyond the first end 84 of the resistive wire. In alternative embodiments of the invention, the ceramic sleeve 86 and returning electrode 70*b* may extend beyond the second end 88 of the resistive wire 76. In addition, the ceramic sleeve 86 may end at the first end 84 of the resistive wire.

The heating element 66 further includes a displacement material 90 such as, but not limited to, MgO. The displacement material 90 is used to fill the remaining space of the cavity 74 of the tubular body 68 and displace any oxygen within the cavity 74. By displacing the oxygen within the cavity 74 with the displacement material 90, the life of the resistive wire 76 is extended. Additionally, the displacement material 90 assists in conducting heat away from the resistive wire 76 and preventing any threat of a short circuit, either of which could reduce the life of the resistive wire 76. As shown in FIG. 7C, the main locations filled by the displacement material 90 include between the resistive wire 76 and the inner surface 78 of the tubular body 68 and between the resistive wire 76 and the ceramic sleeve 86. However, the displacement material 90 fills any additional open spaces within the cavity 74.

At the first end 72 of the tubular body 68, the electrodes 70*a*, 70*b* extend from within the cavity 74, as described above, and out beyond the first end 72 of the tubular body 68. An epoxy 92 is disposed at the first end 72 of the tubular body 68 in order to seal the first end 72. By extending beyond the first end 72 of the tubular body 68, the electrodes 70*a*, 70*b* are configured to extend into a housing (not shown) so as to contact an electrical circuit (not shown) within the housing. As a result, the electrodes 70*a*, 70*b* electrically connect the resistive wire 76 to the electrical circuit within the housing. At the second end 96 of the tubular body 68, the end plug 94 is secured in place at the second end 96 of the tubular body 68 by way of an epoxy 96. The epoxy 96 may be a different or similar epoxy to the epoxy 92 described above.

Figure 8A:
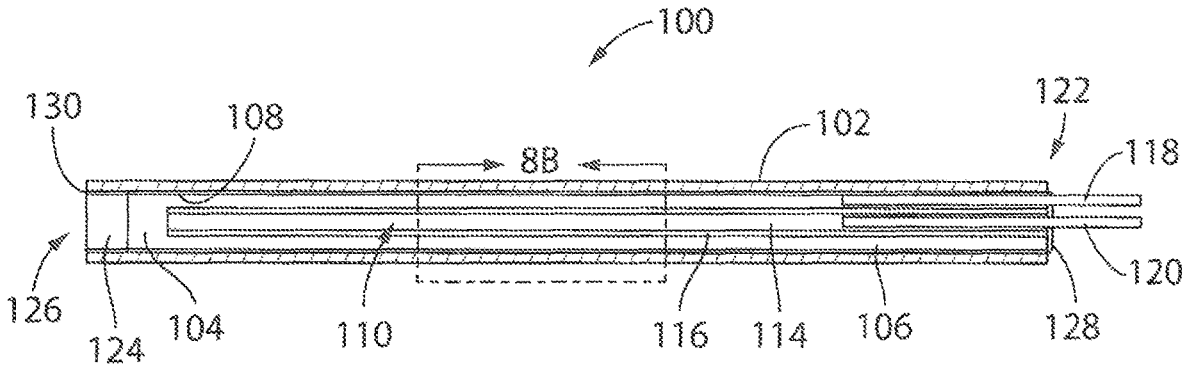
FIG. 8A is a cross-sectional view of a single-ended heating element, according to an embodiment of the invention.
Figure 8B:
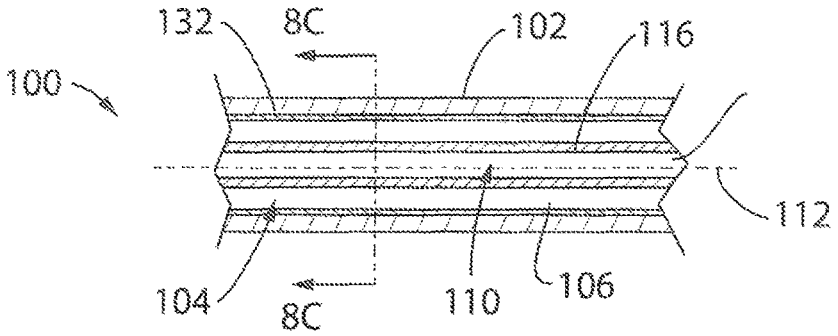
FIG. 8B is an enlarged cross-sectional view of section 8B of the heating element of FIG. 8A.
Figure 8C:
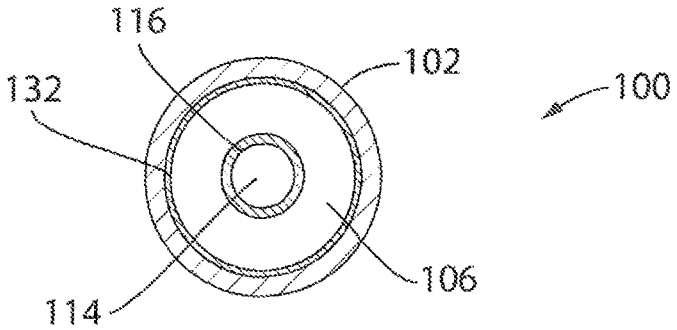
FIG. 8C is a cross-sectional view of the heating element of FIG. 8B taken along line 8C.

Now referring to FIGS. 8A, 8B, and 8C, cross-sectional views of a heating element 100 are shown, according to an alternative embodiment of the invention. Similar to the heating element 66 seen in FIGS. 7A, 7B, and 7C, the heating element 100 is a single-ended heating element. The tubular body 102 of the heating element 100 includes a hollow inner cavity 104 centrally located within the tubular body 102. The tubular body 102 comprises an electrically insulative and thermally conductive material. For example, the tubular body 102 may be a ceramic such as, but not limited to, aluminum oxide, aluminum nitride, and silicon nitride ceramic. The tubular body 102 may be preformed by way of extrusion and firing, pressing and sintering, or any other process known in the art.

Similar to the other described embodiments of the invention, a heat-generating component 106 is disposed within the cavity 104. In this representative embodiment of the invention, the heat generating component 106 is in the form of a composite resistive core. In particular, the composite resistive core 106 is placed within the cavity 104 of the tubular body 102 so that the composite resistive core 106 is directly adjacent an inner surface 108 of the tubular body 102. The composite resistive core 106 may be in the form of a carbon-compound resistor or other resistive core.

It is contemplated that the composite resistive core 106 may be formulated to proportion the resistive compound so as to provide the required resistance. The composite resistive core 106 may be formed by sintering in order to be molded into a shape that fits within the cavity 104 of the tubular body 102. For the purpose of this application, the term sintering may include the use of pressure and heat either alone or in combination. In the representative embodiment of the invention, the composite resistive core 106 may be in the form of a carbon-compound resistor or other resistive core. In alternative embodiments of the invention, the composite resistive core 106 may be disposed within the cavity 104 and the sintered, as defined above, in order to fit within and fill the cavity 104.

As shown in FIG. 8B, a second hollow cavity 110 is formed within the composite resistive core 106. In the representative embodiment of the invention, the hollow cavity 104 of the tubular body 102 and the second hollow cavity 110 of the composite resistive core 106 are both centered along a plane 112. However, in alternative embodiments of the invention the hollow cavity 104 of the tubular body 102 and the second hollow cavity 110 of the composite resistive core 106 may not both be centered along the plane 112.

A conductive core 114 is disposed within the hollow cavity 110 of the composite resistive core 106. In the representative embodiment of the invention, the conductive core 114 is surrounded by a ceramic sleeve 116 also disposed within the hollow cavity 110 of the composite resistive core 106.

The heating element 100 may also include a first electrode 118 and a second electrode 120. The first electrode 118 extends from the composite resistive core 106 of the heating element 100 and through a first end 122 of the tubular body 102. Meanwhile, the second electrode 120 extends from the conductive core 114 of the heating element 100 and through the first end 122 of the tubular body 102. By extending beyond the first end 122 of the tubular body 102, the electrodes 118, 120 are configured to extend into a housing (not shown) so as to contact an electrical circuit (not shown) within the housing. As a result, the electrodes 118, 120 electrically connect the composite resistive core 106 and the conductive core 114, respectively, to the electrical circuit within the housing.

The first end 122 of the tubular body 102 is sealed via an epoxy 128, similar to the epoxy 76 of FIG. 7B. Similar to the heating element 66 shown in FIG. 6, the heating element 100 includes an end plug 124 that is secured in place at a second end 126 of the tubular body 102 by way of an epoxy 130. The epoxy 130 may be a different or similar epoxy to the epoxy 128 described above.

The heating element 100 further includes a displacement material 132 such as, but not limited to, MgO. The displacement material 132 is used to fill the remaining space of the cavity 104 of the tubular body 102 and the cavity 110 of the composite resistive core 106. The displacement material 132 displaces any oxygen within the cavities 104, 110. By displacing the oxygen within the cavities 104, 110 with the displacement material 132, the lives of the composite resistive core 106 and the conductive core 114 are increased. For example, the displacement material 132 assists in conducting heat away from the composite resistive core 106 and the conductive core 114 and also prevents any threat of a short circuit, either of which could reduce the life of the composite resistive core 106 and the conductive core 114.

By pre-forming the tubular body, a manufacturer may exert better control over the geometry of the tubular body after placement of the heat-generating component within the tubular body. Due to the electrical insulation of the tubular body, the heat-generating component and the tubular body are not required to be electrically isolated from one another. As such, the heat-generating component may be placed directly adjacent the tubular body without threat of shorting or damage.

It is further contemplated that the cavity may be filled with the displacement material in a variety of ways. For example, the cavity may be filled with the displacement material by methods including a vibrating fill, centrifuge, or combination thereof. In addition, the cavity may be filled with the displacement material in its dry form or mixed in slurry. For example, the slurry may contain five (5) parts MgO and two (2) parts distilled water or similar combinations. When filling the cavity with slurry, a centrifuge may be used to separate the distilled water from the MgO during filling. After filling, the heating element may be baked or sintered.

The embodiments of the invention described herein result in a heating element having a watt density of at least 300 watts per square inch. In particular, the described immersion heaters herein result in watt densities ranging from 300-750 watts per square inch.

It is specifically intended that the present invention not be limited to the embodiments and illustrations contained herein, but includes modified forms of those embodiments including portions of the embodiments and combinations of elements of different embodiments as come within the scope of the following claims.

What is claimed is:

1. A heating element comprising:

a preformed ceramic tubular body having a hollow cavity centrally located within, wherein the preformed ceramic tubular body is formed from one of aluminum oxide, aluminum nitride, and silicon nitride ceramic;

a heat-generating component disposed within the hollow cavity, wherein the heat-generating component is optionally in electrical contact with the ceramic tubular body;

an air-displacement material disposed within the hollow cavity, wherein the air-displacement material includes magnesium oxide;

at least one electrode having a first end disposed outside the heat-generating component and a second end disposed within the heat-generating component;

the heat-generating component and the air-displacement material being disposed within the hollow cavity of the preformed ceramic tubular body by way of at least one of a vibrating fill and a centrifuge;

wherein the at least one electrode is surrounded by a non-metal sleeve to electrically isolate the at least one electrode from the heat-generating component.

2. The heating element of claim 1, wherein the heat-generating component comprises a resistive wire coiled along a length of the hollow cavity so as to be in contact with the ceramic tubular body.

3. The heating element of claim 1, wherein the heat-generating component comprises a resistive film printed onto a ceramic rod.

4. The heating element of claim 1, wherein the heat-generating component comprises at least one of a composite resistive core sintered to fit within the hollow cavity and a composite resistive core sintered after filling the hollow cavity.

5. A heating element comprising:

a preformed tubular body having a hollow cavity centrally located within, the tubular body comprising an electrically non-conductive material;

a heat-generating component disposed within the hollow cavity, wherein the heat-generating component is optionally in direct contact with the preformed tubular body;

an air-displacement material disposed within the hollow cavity; and at least one electrode extending into the heat-generating component, wherein the at least one electrode is surrounded by a non-metal sleeve to electrically isolate the at least one electrode from the heat-generating component.

6. The heating element of claim 5, wherein the heat-generating component comprises a resistive wire along a length of the hollow cavity so as to be in contact with the tubular body.

7. The heating element of claim 5, wherein the heat-generating component comprises a resistive film on a ceramic rod.

8. The heating element of claim 5, wherein the heat-generating component comprises a composite resistive core within the hollow cavity.

9. A method of manufacturing a heating element comprising:

forming a ceramic tubular body having a hollow cavity centrally located within;

disposing a heat-generating component within the hollow cavity, the heat-generating component being in electrical contact with the tubular body;

filling the hollow cavity with an air-displacement material; and disposing at least one electrode into at least one end of the ceramic tubular body, the at least one electrode extending into the heat-generating component;

wherein the at least one electrode is surrounded by a non-metal sleeve to electrically isolate the at least one electrode from the heat-generating component.

10. The method of claim 9, wherein disposing a heat-generating component within the hollow cavity comprises coiling a resistive wire along a length of the hollow cavity so as to be in contact with the tubular body.

11. The method of claim 9, wherein disposing a heat-generating component within the hollow cavity comprises disposing a ceramic rod having a thick film printed thereon within the hollow cavity.

12. The method of claim 9, wherein disposing the heat-generating component within the hollow cavity comprises disposing a carbon-compound resistor within the hollow cavity, the carbon-compound resistor being at least one of sintered to fit within the hollow cavity and sintered after filling the hollow cavity.

* * * * *